US006530120B2

(12) United States Patent
Samelson

(10) Patent No.: US 6,530,120 B2
(45) Date of Patent: Mar. 11, 2003

(54) ROLLER SHOWER CURTAIN HOOK AND METHOD OF MANUFACTURING SAME

(75) Inventor: David Samelson, Morristown, NJ (US)

(73) Assignee: Ex-Cell Home Fashions, Inc., New York, NY (US)

( * ) Notice: Subject to any disclaimer, the term of this patent is extended or adjusted under 35 U.S.C. 154(b) by 0 days.

(21) Appl. No.: 09/912,584

(22) Filed: Jul. 26, 2001

(65) Prior Publication Data

US 2003/0028998 A1 Feb. 13, 2003

(51) Int. Cl.[7] ..... E05D 15/00; A47H 13/00

(52) U.S. Cl. ..... 16/87.2; 16/87.8

(58) Field of Search ..... 16/87.2, 87.6 R, 16/87.8; 24/306, 716; D8/367, 372; 160/346, 330, 348; 248/60, 62; 4/608, 609, 610

(56) References Cited

U.S. PATENT DOCUMENTS

| | | | | | |
|---|---|---|---|---|---|
| 387,392 | A | * | 8/1888 | Braddock | 16/87.8 |
| 396,604 | A | * | 1/1889 | Rings | 16/87.8 |
| 460,793 | A | * | 10/1891 | Rings | 16/87.8 |
| 699,507 | A | * | 5/1902 | Erich | 16/87.8 |
| 1,721,338 | A | * | 7/1929 | Gagnon | 16/87.8 |
| 1,857,293 | A | * | 5/1932 | Vroom | 16/87.8 |
| 2,008,471 | A | * | 7/1935 | Schroeder | 16/87.8 |
| 2,320,003 | A | * | 5/1943 | Madan | 16/87.8 |
| 2,538,755 | A | * | 1/1951 | Bradley | 16/102 |
| 2,741,923 | A | * | 4/1956 | Bradley | 16/102 |
| D350,279 | S | | 9/1994 | Tate | |
| 5,586,375 | A | * | 12/1996 | Cooperman et al. | 16/87.2 |
| D404,639 | S | | 1/1999 | Samelson | |

FOREIGN PATENT DOCUMENTS

EP 1205139 A2 * 5/2002

* cited by examiner

*Primary Examiner*—Chuck Y. Mah
(74) *Attorney, Agent, or Firm*—Robert L. Epstein; Harold James; James & Franklin, LLP

(57) ABSTRACT

The hook has a molded plastic body including a rod engaging part formed of arcuate sections with roller bearing receiving cavities. Means for joining the sections are provided. The hook is assembled by placing the roller bearings in the cavities in one of the sections. The sections are then aligned and joined together. The hook body also includes a curtain receiving part, integral with one of the rod engaging part sections. The curtain receiving part includes oppositely inclined portions. The portions meet at a point along the vertical axis of the hook.

16 Claims, 4 Drawing Sheets

FIG. 3
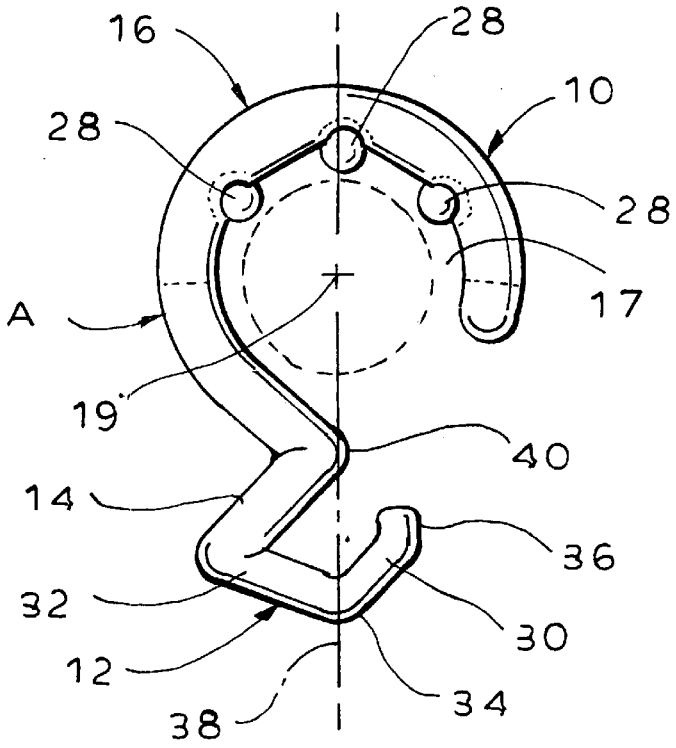
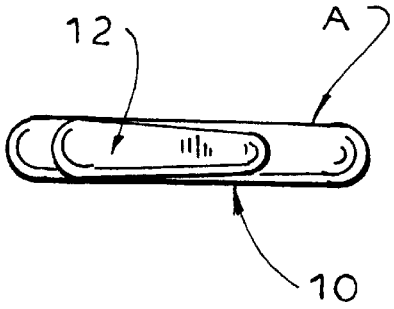
FIG. 4

ROLLER SHOWER CURTAIN HOOK AND METHOD OF MANUFACTURING SAME

The present invention relates to hooks for suspending a shower curtain and/or a shower curtain liner from a shower curtain rod and more particularly to such a hook fabricated of molded plastic that includes multiple metal roller bearings and has a self-centering curtain engaging part, and to a method for manufacturing such a hook.

Shower curtains formed of fabric or plastic sheet material and/or shower curtain liners formed of plastic sheet material are suspended by hooks which moveably engage a horizontal shower curtain rod. The hooks include a rod engaging part which is usually arcuate in shape to correspond with the circular cross-sectional shape of the rod. Below the rod engaging part is a part which is received into openings in a shower curtain and/or a shower curtain liner. For simplicity, the term shower curtain as used herein will be used to mean a shower curtain, a shower curtain liner, or both.

Conventional shower curtain hooks are made of metal or injection molded plastic. They are adapted to slide along the surface of the rod to permit the curtain to be moved as required.

In order to facilitate movement of the hook along the rod, bearings in the form of one or more metal round or cylindrical shaped bearings have been rotatably mounted on the rod engaging part of the hook. This can be accomplished by forming a channel through each bearing and inserting the rod engaging part through the bearing channels. The bearings can be adjacent to each other or spaced along the rod engaging part. See, for example, U.S. Design Pat. No. 404,639 entitled "Shower Curtain Ring" issued Jan. 26, 1999 to Samuel Samelson and U.S. Design Pat. No. 350,279 issued Sep. 6, 1994 entitled "Shower Curtain Ring" to Richard S. Tate.

When bearings are employed, the rod engaging part must be made of metal because it must be strong enough to hold the weight of the curtain and at the same time must be small enough in diameter to be received within the channels in the bearings such that the bearings can rotate freely. However, hooks made of metal are more costly to manufacture than those made of plastic, as they must be fabricated from rust resistant metal to prevent rusting in the high moisture environment in which they are designed to function.

The present invention relates to a hook with rust resistant metal bearings that overcomes the high cost of utilizing a metal body and of forming channels through the metal bearings. This is achieved by utilizing a two-part plastic injection molded hook body with roller bearing cavities formed therein. After the body parts are formed, the roller bearings are inserted into the cavities and the parts are joined. The result is a hook that is much less expensive to fabricate and assemble than conventional metal roller hooks.

It is, therefore, a prime object of the present invention to provide a roller shower curtain hook fabricated of plastic with internal cavities formed to receive rust resistant metal ball bearings which is relatively inexpensive to manufacture and simple to assemble.

It is another object of the present invention to provide a roller shower curtain hook with a self-centering curtain receiving part which aligns the curtain along the centerline of the hook passing through the center point of the rod engaging part.

It is another object of the present invention to provide a method of manufacturing a roller shower curtain hook in which the plastic rod engaging part is formed of arcuate sections with bearing cavities and means for joining the sections, which is easy to assemble by placing the bearings in the cavities, aligning the sections and joining them together.

In accordance with one aspect of the present invention, a shower curtain hook is provided for use with a curtain rod. The hook includes a molded plastic rod engaging part and a curtain receiving part. A roller bearing is provided. The rod engaging part is adapted to be situated proximate the rod. It includes a cavity adapted to rotatably receive the roller bearing.

Additional cavities in the rod engaging part section are adapted to receive additional roller bearings. The additional roller bearing receiving cavities are spaced from and located on either side of the first cavity.

Preferably, the rod engaging part is arcuate. The roller bearing cavity is concave.

The curtain receiving part includes first and second oppositely inclined portions.

The hook also includes a part connecting the rod engaging part and the curtain receiving part. The connecting part is substantially parallel to the first inclined portion of the curtain receiving part.

The hook has a centerline. The rod engaging part defines a recess with a center point. The centerline passes through the center point and the junction of the first and second inclined portions of the curtain receiving part. Preferably, the junction of the rod engaging part and the connecting part is also situated along the centerline.

The rod engaging part is formed of two sections. Each of the sections defines a portion of the first cavity. Each of the sections also defines a portion of each of the additional cavities.

Means are provided for joining the sections to each other. Preferably, the joining means takes the form of friction engagement means. Preferably, one of the sections is integral with the remainder of the hook.

Preferably, the sections are arcuate in shape.

In accordance with another object of the present invention, a method for fabricating a shower curtain hook with a roller bearing is provided. The method includes the steps of forming the hook with the rod engaging part in two separate sections. Each section defines a portion of a roller bearing receiving cavity. The roller bearing is inserted into the cavity portion in one of the sections. The sections are positioned such that the cavity portions align. The sections are joined together to complete the assembly.

The remainder of the hook is integral with one of the sections.

The hook also includes a curtain receiving part. The step of forming the hook includes forming the curtain receiving part integral with one of the sections.

The sections are joined by friction engagement means which include a protrusion extending from one of the sections and a protrusion receiving recess on the other of the sections.

The hook is adapted for use with multiple roller bearings. The step of forming the rod engaging part includes forming each section with a portion of each of multiple roller bearing receiving cavities. The step of inserting comprises inserting a roller bearing into each of the cavity portions.

To these and to such other objects which may hereinafter appear, the present invention relates to a roller shower curtain hook and method of manufacturing same, as set forth in the following specification; recited in the annexed claims and illustrated in the accompanying drawings, where like numerals refer to like parts and in which:

FIG. 3 is a side elevational view of the hook;

FIG. 4 is a bottom elevational view of the hook;

Figure 1:
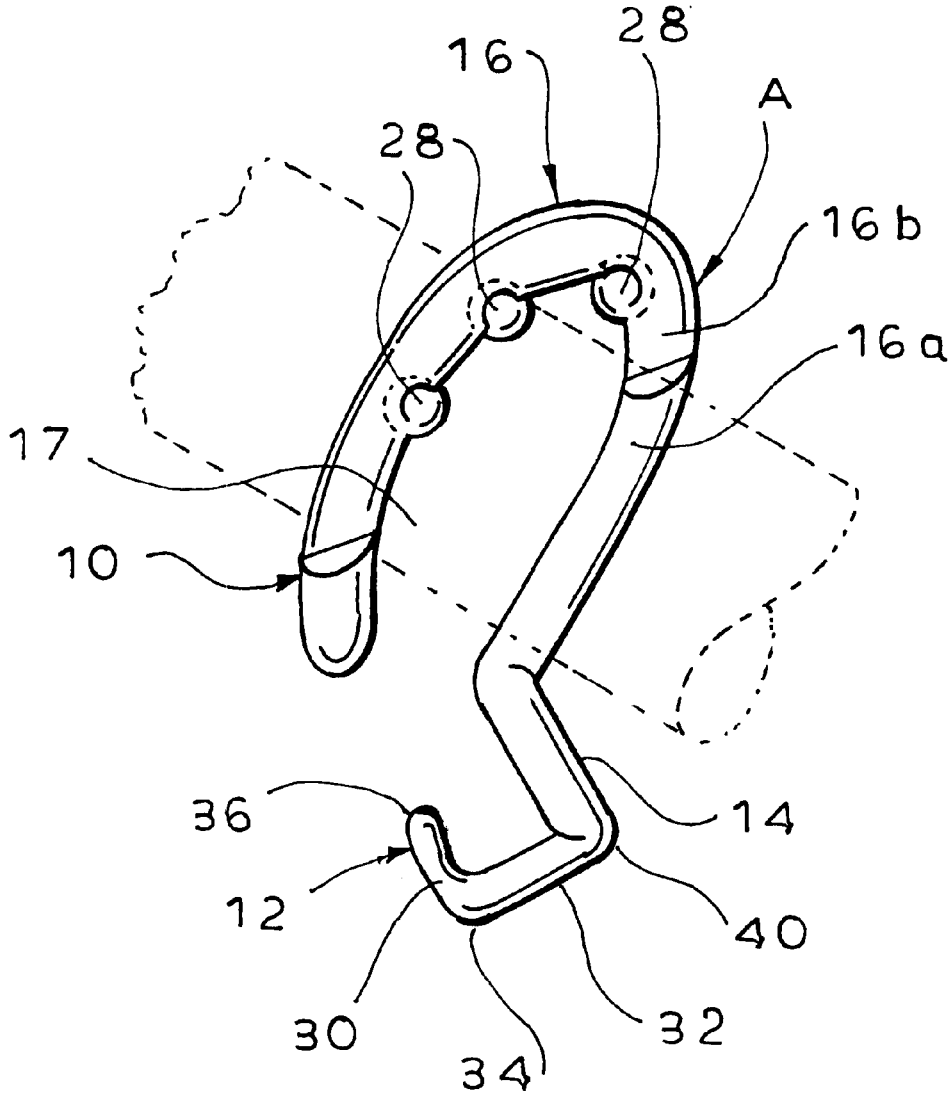
FIG. 1 is an isometric view of the hook of the present invention, as it would appear on a curtain rod.

As seen in the drawings, the hook of the present invention is formed of an injection molded plastic body, generally designated A, with a rod engaging part 10, a curtain receiving part 12 and a part 14 connecting parts 10 and 12.

Rod engaging part 10 has an arcuate portion 16 which defines a recess 17 into which a curtain rod is adapted to be received. Recess 17 has a center point 19, best seen in FIG. 3. Portion 16 is formed of two arcuate sections 16*a* and 16*b*. Section 16*b* is formed separate from the remainder of body A, whereas section 16*a* is integral with the remainder of the hook body.

Figure 2:
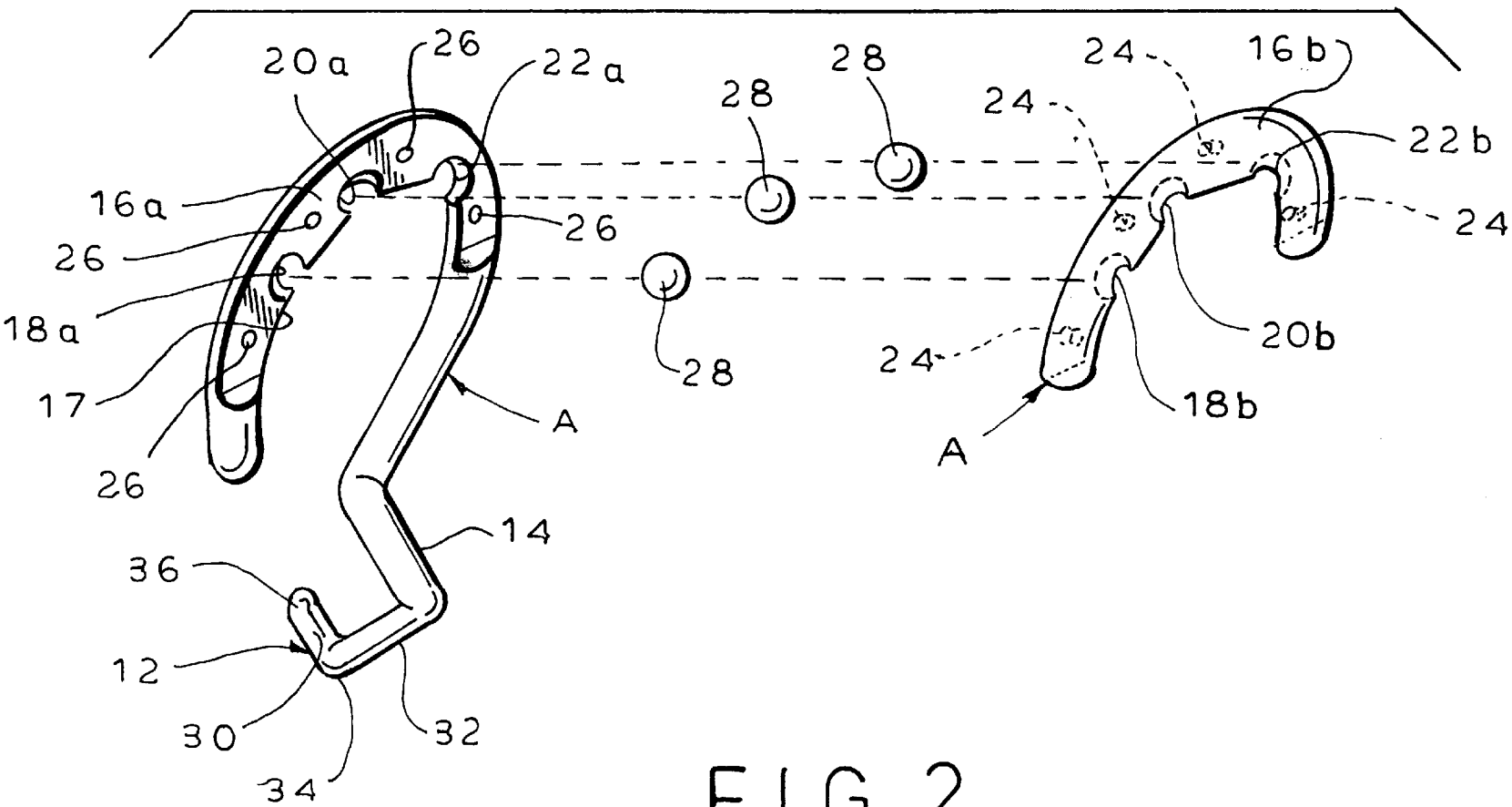
FIG. 2 is an exploded isometric view of the hook of the present invention.
Figure 5:
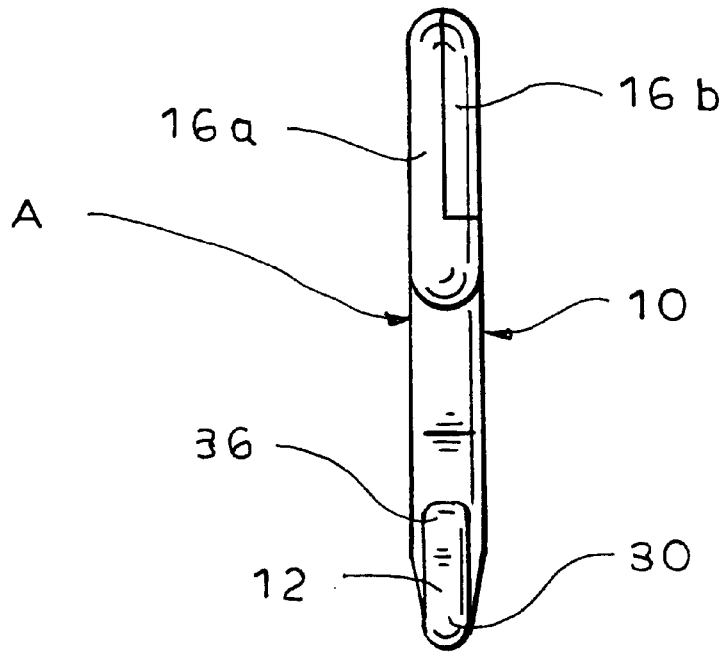
FIG. 5 is front elevational view of the hook.
Figure 6:
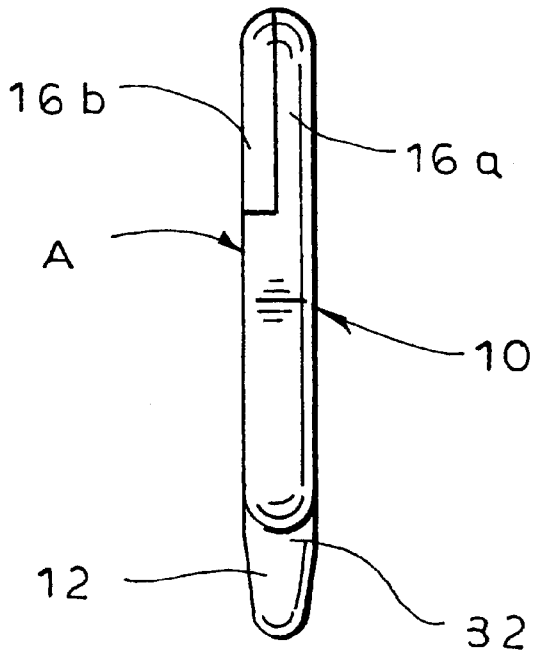
FIG. 6 is a rear elevational view of the hook.

As best seen in FIG. 2, molded into section 16*a* is a portion of each of three, spaced, concave ball bearing receiving cavities 18*a*, 20*a* and 22*a*. Molded into section 16*b* is the mating portion of each of the three, spaced concave ball bearing receiving cavities 18*b*, 20*b* and 22*b*.

Also molded into section 16*b* are four protrusions 24. Molded into section 16*a* are four protrusion receiving recesses 26.

Curtain receiving part 12 includes oppositely inclined portions 30, 32 which meet at junction 34 and act to self-center the curtain on part 12. Connecting part 14 is substantially parallel to portion 30 of part 12. The end of part 12 has an upstanding lip 36 which keeps the curtain from accidentally falling off the hook.

The hook is balanced about a centerline 38. As seen in FIG. 3, centerline 38 passes through the center point 19 of recess 17, the junction 40 between connecting part 14 and rod engaging part 10, and the junction 34 between portions 30 and 32 of the curtain receiving part 12.

The hook of the present invention is molded in two parts, section 16*b*, which is one part, and the remainder of the body, which includes section 16*a*, which is the second part. Assembly is simple.

To assemble the hook, rust resistant metal ball bearings 28 are placed in cavities 18*a*, 20*a* and 22*a* in section 16*a* and section 16*b* is positioned with its cavities 18*b*, 20*b* and 22*b* aligned with the corresponding cavities of section 16*a*. The sections are then "snap-fitted" together such that protrusions 24 are received within and frictionally engage recesses 26. The sections may also be joined by adhesive, or by heat or sonic welding, or any other conventional means.

It should now be appreciated that the hook of the present invention has a molded plastic body formed of two sections with bearing receiving cavities formed therein. With the bearings in place, the sections are joined together to assemble the hook. The hook has a self-centering curtain receiving part, situated along the centerline of the hook, such that the hook is always properly balanced on the curtain rod.

While only a single preferred embodiment of the present invention has been disclosed for purposes of illustration, it is obvious that many variations and modifications could be made thereto. It is intended to cover all of these variations and modifications, which fall within the scope of the invention, as defined by the following claims:

I claim:

1. A shower curtain hook for use with a curtain rod, said hook comprising a molded plastic body comprising a rod engaging part and a curtain receiving part, and a roller bearing, said rod engaging part being adapted to be situated proximate the rod and comprising a first cavity adapted to rotably receive said roller bearing, said rod engaging part being formed of two sections, each of said sections defining a portion of said first cavity and further comprising means for joining said sections to each other.

2. The hook of claim 1 further comprising additional roller bearings and additional cavities in said rod engaging part adapted to receive said additional roller bearings.

3. The hook of claim 2 wherein said additional roller bearing receiving cavities are spaced from and located on either side of said first cavity.

4. The hook of claim 2 wherein said rod engaging part is formed of two sections, each of said sections defining a portion of each of said additional cavities.

5. The hook of claim 1 wherein said curtain receiving part comprises first and second oppositely inclined portions.

6. The hook of claim 5 further comprising a part connecting said rod engaging part and said curtain receiving part, said connecting part being substantially parallel to said first inclined portion.

7. The hook of claim 5 wherein said hook has a centerline, wherein said rod engaging part defines a recess with a center point, and wherein said centerline passes through said center point and the junction of said first and second inclined portions.

8. The hook of claim 7 further comprising a part connecting said rod engaging part and said curtain receiving part, wherein the junction of said rod engaging part and said connecting part is situated along said centerline.

9. The hook of claim 1 wherein one of sections is integral with the remainder of said body.

10. The hook of claim 1 wherein said sections are arcuate.

11. A method of fabricating a plastic shower curtain hook with a rod engaging part and a roller bearing comprising the steps of forming the hook with the rod engaging part in two sections, each section defining a portion of a roller bearing receiving cavity, inserting the roller bearing into said cavity portion in one of the sections, positioning the sections such that the cavity portions align and joining the sections together.

12. The method of claim 11 wherein the remainder of the hook has a shower curtain receiving part and further comprising the step of forming the shower curtain receiving part to be integral with one of said sections.

13. The method of claim 11 wherein said hook comprises a curtain receiving part and wherein the step of forming the hook comprises forming said curtain receiving part integral with one of said sections.

14. The method of claim 11 wherein said step of joining the sections comprises inserting a protrusion extending from one of said sections into a protrusion receiving recess in the other of said sections.

15. The method of claim 11 wherein the hook is adapted for use with multiple roller bearings and wherein the step of forming the rod engaging part comprises forming each section with a portion of each of multiple roller bearing receiving cavities and wherein the step of inserting comprises inserting a different roller bearing into each of the cavity portions.

16. The method of claim 11 wherein the step of joining the sections comprises the step of affixing the sections to each other.

* * * * *